United States Patent [19]

Arbogast et al.

[11] Patent Number: 5,011,709

[45] Date of Patent: Apr. 30, 1991

[54] METHOD FOR MODIFYING THE SURFACE STATE OF MATERIALS, IN PARTICULAR OF THE PAPER AND/OR CARD TYPE

[75] Inventors: Romain Arbogast, Nevers; Albert Gervie, Lozanne, both of France

[73] Assignee: Oris, Lyons, France

[21] Appl. No.: 253,431

[22] Filed: Oct. 4, 1988

[30] Foreign Application Priority Data

Oct. 5, 1987 [FR] France ..... 87 13733

[51] Int. Cl.[5] ..... B05D 3/06

[52] U.S. Cl. ..... 427/56.1; 427/198; 427/202; 427/348; 427/374.4; 427/375; 427/378; 427/398.1

[58] Field of Search ..... 427/197, 55, 261, 374.3, 427/375, 377, 381, 391, 398.1, 56.1, 202, 348, 374.4, 378

*Primary Examiner*—Bernard Pianalto

*Attorney, Agent, or Firm*—Browdy and Neimark

[57] ABSTRACT

A method of modifying the surface state of a material or a medium, in particular of the paper and/or card type for the purpose, in particular, of printing on said surface or medium, whereby a plurality of inks and/or varnishes are applied simultaneously on the surface of said material, said inks and/or varnishes being deposited or treated in such a manner as to provide zones on the material or medium suitable for retaining dusting particles which adhere exclusively on said zones, with excess dusting particles then being removed by suction and/or blowing, with said operation being followed by drying at a temperature and for a period of time suitable for fixing all of the types of ink or varnish, wherein the dusting comprises thermoplastic or hot-setting powders which are melted in an atmosphere of air having sufficient humidity to counter a large drop in the humidity of the medium under the effect of the means for melting the powders. Applicable to printing in relief on paper and card.

7 Claims, 1 Drawing Sheet

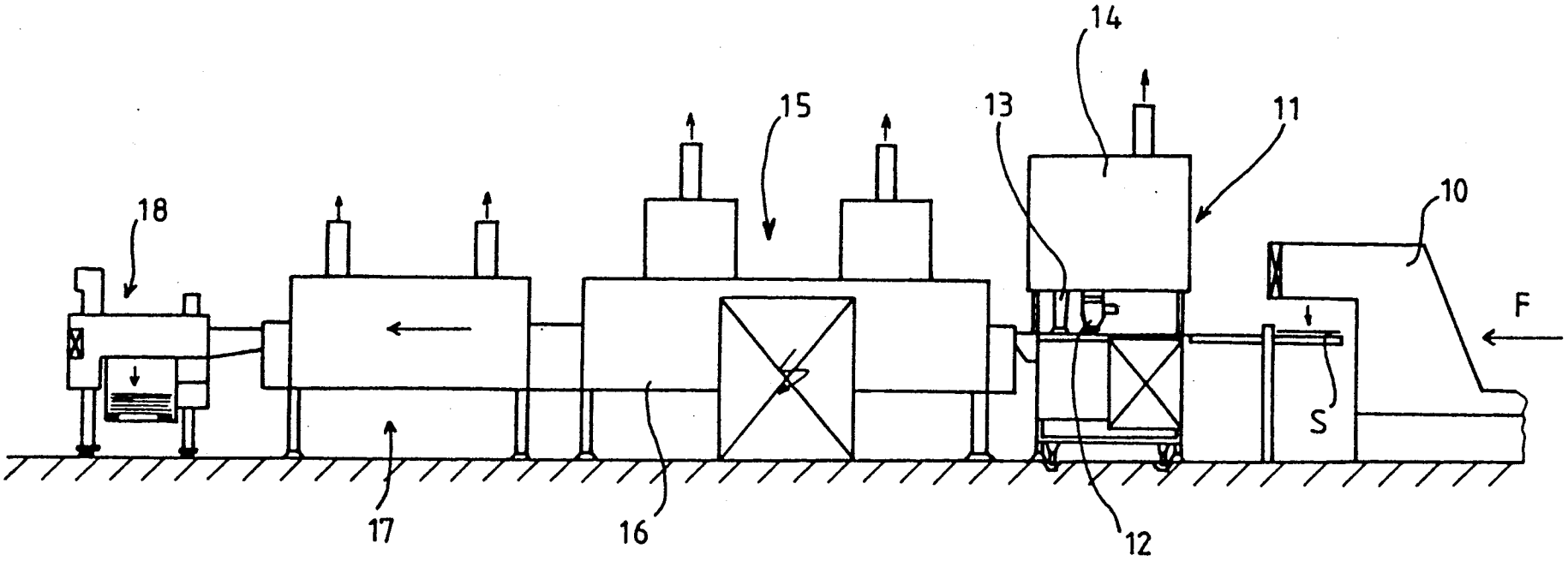
F
10
S
11
12
14
13
15
16
17
18

METHOD FOR MODIFYING THE SURFACE STATE OF MATERIALS, IN PARTICULAR OF THE PAPER AND/OR CARD TYPE

The invention relates to an improved method and installation for modifying the surface state of materials or media, in particular of the paper and/or card type for the purpose, in particular, of printing on said surfaces or media.

BACKGROUND OF THE INVENTION

Amongst the numerous methods of modifying the surface state of materials such as paper or card for the purpose of printing thereon, proposals have already been made, e.g. in French patent specification No. FR-A-2 543 060, to apply a plurality of offset, silk-screen, or letterpress inks or varnishes having different polymerization temperatures and speeds, to perform pre-drying at an appropriate temperature and for a sufficient length of time to polymerize a certain type of ink and then to apply dusting particles to the treated surface, with the particles adherring solely to those inks which have not yet polymerized, and then to perform drying at an appropriate temperature and for an appropriate length of time to complete the polymerization of all the types of ink after removing excess dusting particles by suction and/or by blowing.

Although such a method gives satisfaction with dusting powders such as metal powders, asbestos powder, cork powder, etc. . . . , a number of precautions need to be taken when said dusting powders are based on thermoplastic or hot-setting materials which are caused to melt by appropriate heating means, in particular if the method is intended to be applied to treating surfaces which are very wide, or to certain types of special materials.

Although implementing the method of the above-mentioned French patent gives excellent results even when using powders of thermoplastic or hot-setting materials, for producing articles such as greetings cards, advertising sheets, magazine covers, etc., when the method is performed on media of larger sizes, the dusting treatment and in particular the time it takes causes the cost of articles manufactured in this way to become prohibitive, industrially.

Consequently, an object of the invention is to provide improvements to the above-outlined method which make it economically advantageous to perform the method regardless of the type of surface to be treated, and in particular on surfaces of great width, in the form of large sheets or in the form of reels.

Another object of the invention is to provide an installation for implementing the improved method, and in particular such an installation for printing on paper or card and suitable for treating sheets or reels having a width of 1020 mm to up to 1600 mm at a high or a very high rate.

SUMMARY OF THE INVENTION

The problem is solved, according to the invention, by a method of modifying the surface state of a material or a medium, in particular of the paper and/or card type for the purpose, in particular, of printing on said surface or medium, whereby a plurality of inks and/or varnishes are applied simultaneously on the surface of said material, said inks and/or varnishes being deposited or treated in such a manner as to provide zones on the material or medium suitable for retaining dusting particles which adhere exclusively on said zones, with excess dusting particles then being removed by suction and/or blowing, with said operation being followed by drying at a temperature and for a period of time suitable for fixing all of the types of ink or varnish, wherein the dusting comprises thermoplastic or hot-setting powders which are melted in an atmosphere of air having sufficient humidity to counter a large drop in the humidity of the medium under the effect of the means for melting the powders.

In a preferred implementation, powders are melted under conditions such that the material or medium to be treated, in particular of the paper or card type, is subjected to a relative loss of humidity which is no greater than 10% of its initial humidity.

The powders may be thermoplastic or hot-setting high polymers brought to the molten state by one or more sources of infra-red radiation.

In a preferred implementation of the invention, the thermoplastic or hot-setting powders are melted in such a manner that the temperature of the treated surface or medium does not exceed a predetermined value, e.g. about 90° C. for paper or card.

Whatever type of heating means are used, particularly, but not exclusively a source of infra-red radiation, the invention provides for said means to be preferably used at their greatest intensity value immediately on being brought into use, rather than being used progressively.

When infra-red radiation is used to apply the heat for melting the powders, the invention provides for adapting the wavelength of the radiation to the natures of said powders.

Thus, good results have been obtained for melting thermoplastic powders by using radiation having a wavelength lying between $3\mu$ and $3.8\mu$ for thermoplastic powders and by using radiation having a wavelength lying in the range $2.5\mu$ to $3.4\mu$ for melting hot-setting powders.

The method of the invention in which the thermoplastic or hot-setting powders are melted in an environment of humid air, at a humidity of not less than 85% to 95%, thus makes it possible to reach the melting temperatures of said powders of about 115° C. to 140° C. without the temperature of the media or materials to be treated exceeding 80° C. to 90° C.

The method of the invention then gives rise to goods of excellent quality regardless of the type of medium or material used, in sheet form or in reel form, and including widths of as much as 1020 mm to 1600 mm.

According to the invention, an installation for implementing the improved method comprises a print unit, a unit for depositing powder on some of the ink zones of the medium, means for removing excess dusting particles by suction and/or blowing, and further comprises a unit for causing said powders to melt in an atmosphere of air which is sufficiently humid to oppose any large decrease in the humidity of the medium, followed by a unit for cooling the media leaving the melting unit.

BRIEF DESCRIPTION OF THE DRAWING

An implementation of the invention is described, by way of example, with reference to the sole FIGURE of the accompanying drawing which is a diagram of an installation in accordance with the invention.

MORE DETAILED DESCRIPTION

The installation comprises a print unit 10, e.g. an offset, letterpress, or photogravure type press, through which the material or medium runs in the direction of arrow F. The press of the unit 10 is of conventional type having at least two different blankets for transferring onto the material or medium to be treated either inks from different families or else inks from the same family but having different drying characteristics, or even inks and colorless varnishes. In the first case (inks of different families) one of them may be of the wet or dry offset type, polymerizing under the effect of ultraviolet radiation, and the other may be a conventional wet or dry offset ink or a wet or dry offset ink of the type that can be dust-proofed by infra-red radiation, etc.; in the second case (inks of the same family) the drying means which are advantageously of the infra-red type and integrated in the press, are adjusted so as to cause some colors to dry completely while drying others only partially, such that the materials or media leaving the print unit have tacky zones suitable for retaining dusting particles; in the third case the print unit 10 is organized such that after it has deposited inks of various colors all of which dry quickly under heater means of the infra-red type, it deposits a colorless varnish via a last print roll which is not subjected to the drying process and which then defines tacky zones for retaining the dusting particles.

The particles are deposited in a unit 11 which is essentially constituted by a device 12 for dusting on thermoplastic or hot-setting powders having strictly controlled grain size and delivered in the form of a curtain coming from at least one slot extending transversely to the direction of displacement of the print material or medium and followed by a device 13 for sucking up and/or blowing away excess powder particles, which particles are recycled via the body 14 of the unit 11 prior to being dusted on again by the device 12.

Following the unit 11, the installation includes a powder melting unit which, in accordance with the invention, is made in such a manner that melting takes place in an atmosphere of air whose humidity is high enough to oppose any significant drop in the humidity of the medium S. On leaving the unit 11, the medium is displaced on a conveyor belt which is advantageously in the form of adjacent perforated strips against which the powder-coated medium is held by setting up powerful suction in an enclosure 16 which is integrally formed with the unit 15. The enclosure 16 also contains a multiplicity of infra-red radiators placed at an adjustable distance from the conveyor belt with high humidity air (90%–95%) as a temperature of about 80° C.–85° C. being blown by a blower (not shown) in a downwards direction between the radiators and the conveyor belt.

Thus, surprisingly, the powder deposited by the device 12 is caused to melt and thus form portions in relief on the media S travelling in the direction of arrow F, which portions in relief appear to the eye of the user as having the same tint or color as the zones on which they are deposited and which were printed with said tint or color on passing through the print unit 10.

Depending on the natures of the powders used, the wavelength of the infra-red radiation emitted by the radiators disposed in the enclosure 16 may be selected appropriately.

Thus, for the purpose of melting thermoplastic powders, the invention provides for using radiation having a wavelength lying in the range 3μ to 3.8μwhereas for melting hot-setting powders, said wavelengths should be selected in the range 2.5μ to 3.4μ.

A servo-control system (not shown) controls the operation of the unit 15 as a function of the temperature of the material or medium S on leaving said unit, with the servo-control system being adjusted so that said temperature does not exceed 80° C.–90° C. when paper or card is being used.

By permanently blowing humid air into the enclosure 16, it is also possible to counter the loss of humidity from the medium S, with air blow rate and the other operating parameters of the unit 15 being adjusted so that the humidity of the medium does not drop below 50%–40%, and preferably not below 45% as it passes through said unit, since the medium becomes unusable at lower humidity values because of shrinking, with the effect of shrinking increasing with increasing medium width.

The material or medium S whose temperature at the outlet from the unit 15 is about 80° -90° C. is then cooled, and for this purpose the invention provides for a unit 17 in which the media S travels pressed against a conveyor belt by suction applied to their rear faces while their front faces receive refrigerated air at a temperature lying between 5° C. and 10° C.

On leaving the cooling unit 17, the printed materials or media S are stacked in a receiver unit 18 which is advantageously of the air cushion type both to avoid any additional handling and also to absorb the throughput of the installation which is governed by the drying devices in the print unit, and which is about 6,000 sheets per hour.

The following non-limiting examples illustrate the invention further.

EXAMPLE 1

Paper 90 grams per square meter ($g/m^2$) sheets coated on one face and corresponding to a quality commonly used for heavy labels are printed by the method of the invention and using a Roland offset press. The sheets receive printing in three different colors of conventional UV-drying, wet-type, offset ink for the purpose of forming flat tints or non-relief printing, and in registering zones then receive printing by a conventional wet offset ink having a blue color different from the first three colors an intended to form adherence zones for powders which, after melting, provide portions in relief on said media, with each of the inks being applied at about 2 $g/m^2$.

The powder used is a polyamide based thermoplastic type powder having an average grain size of 145 microns and it is deposited at 10 $g/m^2$.

The installation is adjusted for a sheet travel speed of 85 meters per minute and the powder held by the blue colored wet offset ink is dried by means of infra-red panels adjusted to an emission wavelength of about 3.4 microns and located in an enclosure into which air at 85% humidity and at a temperature of about 90° C. is permanently injected.

When using a cooling air temperature of about 5° C. in the unit 17, the receiver unit 18 stacks sheets having a temperature of about 35° C. and having blue colored zones with relief to an average thickness of 45 microns.

EXAMPLE 2

120 g/m² paper with a 20 g/m² coating on its front face and a 10 g/m² coating on its rear face, and of a type corresponding to a conventional quality for advertising leaflets, is treated by the method of the invention.

The three basic colors for providing flat tints or printing without relief are UV wet offset inks, whereas the zones for fixing the hot-setting powder are defined by means of a conventional wet offset varnish. The varnish is applied in register with two of the three initial colors of ink in order to give rise under the same operating conditions as described in Example 1 to particularly attractive printing on the leaflet using a powder of the alkyde family.

EXAMPLE 3

Card

A 330 g/m² medium having a 20 g/m² coating on its front face and no coating on its rear face, and of a quality corresponding to that used for making folding boxes for packaging, is processed by the method of the invention.

A treatment analogous to that described with reference to Example 1 is applied thereto using a polyamide type powder having an average grain size of 165 microns and deposited at about 15 g/m² onto the inks which are themselves deposited at about 2.5 g/m².

With the installation adjusted for a throughput speed of 77 meters per minute, and with its other operating parameters adjusted to very substantially the same values as in Example 1, sheets are obtained at the outlet from the installation for stacking in the receiver unit 18 at a temperature of about 38° C. and with zones in relief associated with the color of ink corresponding to a non-UV conventional wet offset ink and having an average thickness of 52 microns.

EXAMPLE 4

Proceed as for Example 2, but using 220 g/m² card coated to 20 g/m² on its front face and uncoated on its rear face.

Such a medium which is intended to be glued, after printing, onto average quality heavy card or onto corrugated card and is treated as described above, i.e. by means of three UV wet offset inks for the basic colors and by a conventional colorless wet offset varnish which is not UV treated in order to define zones on two of the basic colors for retaining the thermoplastic powder used, with the operating parameters of the installation being as defined in Example 3.

The invention is not limited to the embodiments and implementations described above. Thus, although the method has been described with reference to examples using wet offset ink, it is naturally capable of being implemented with dry offset inks.

Similarly, although the print unit has been described as being of the offset, letterpress, photogravure, or feedback type, other methods are naturally also applicable, for example silk-screen type methods, or the like.

We claim:

1. A method of modifying the surface state of a print medium, the method comprising the steps of:

simultaneously applying a plurality of printing fluids on the surface of the print medium in such a manner as to provide dusting zones on the medium suitable for retaining dusting powder particles which adhere exclusively on said zones;

dusting a dusting powder onto said medium including said dusting zones;

removing excess dusting powder by means of a flow of air;

and heating the medium to fix the printing fluids and the dusting powder particles retained thereby, said heating being equivalent to the use of radiation at a wavelength of 2.5–3.8 μ;

wherein said dusting powder is constituted by a substance which melts on heating and which is set after subsequent cooling, and wherein said heating step is performed in an atmosphere of hot air at a temperature of at least about 115° C. sufficient to melt said dusting powder and having a degree of humidity not less than 85% and sufficient to counter a large drop in the humidity of the medium under the effect of the heating, the temperature of the surface of said print medium not exceeding about 90° C. during said heating.

2. A method according to claim 1, wherein said powder is melted under conditions such that the print medium is subjected to a relative loss of humidity which is no greater than 10% of its initial humidity.

3. A method according to claim 1, wherein said powder comprises at least one high polymer, and wherein said powder is melted by means of at least one source of infra-red radiation.

4. A method according to claim 3, wherein the wavelength of the infra-red radiation is adapted to the nature of said powder.

5. A method according to claim 4, wherein radiation having a wavelength lying between 3μ and 3.8μ is used for thermoplastic powders and radiation having a wavelength lying in the range 2.5μ to 3.4μ is used for melting hot-setting powders.

6. A method according to claim 1, wherein said step of heating the print medium is performed by means which are used at their greatest intensity value immediately on being brought into use, rather than being used progressively.

7. A method according to claim 1, wherein said powder is melted in an environment making it possible to reach the melting temperature of said powder in the range about 115° C. to about 140° C.

* * * * *